US006332297B1

(12) United States Patent
Butigieg

(10) Patent No.: US 6,332,297 B1
(45) Date of Patent: Dec. 25, 2001

(54) DEVICE FOR FACILITATING THE REMOVAL OF FORMWORK

(75) Inventor: Johnny Butigieg, Nanterre (FR)

(73) Assignee: Compagnie du Sol, Nanterre (FR)

( * ) Notice: Subject to any disclaimer, the term of this patent is extended or adjusted under 35 U.S.C. 154(b) by 0 days.

(21) Appl. No.: 09/520,847

(22) Filed: Mar. 8, 2000

(30) Foreign Application Priority Data

Mar. 19, 1999 (FR) ..... 99 03428

(51) Int. Cl.[7] ..... E04B 5/00

(52) U.S. Cl. ..... 52/376; 52/127.2; 52/576; 52/98; 52/99; 249/207

(58) Field of Search ..... 52/127.1, 127.2, 52/376, 576, 764, 98, 99; 249/188, 207, 210, 9; 264/34

(56) References Cited

U.S. PATENT DOCUMENTS

| | | | | |
|---|---|---|---|---|
| 2,911,702 | * | 11/1959 | Clyncke | 25/118 |
| 3,978,626 | * | 9/1976 | Weinar | 52/127 |
| 4,112,646 | * | 9/1978 | Clelland | 52/372 |
| 4,333,290 | * | 6/1982 | Koberstein | 52/376 |

FOREIGN PATENT DOCUMENTS

| | | | | |
|---|---|---|---|---|
| 679790 | | 4/1992 | (CH) . | |
| 299166637-U1 | * | 3/2000 | (DE) | 52/376 |
| 0462010 | | 12/1991 | (EP) . | |
| 2315803 | | 2/1998 | (GB) . | |
| 61257530 | | 11/1986 | (JP) . | |

* cited by examiner

*Primary Examiner*—Carl D. Friedman
*Assistant Examiner*—N. Slack
(74) *Attorney, Agent, or Firm*—Dennison, Scheiner, Schultz & Wakeman

(57) ABSTRACT

The invention relates to a device for facilitating the removal of formwork for the end joint of a diaphragm wall panel, said formwork comprising a soleplate having two side edges. The device comprising:

two substantially rectangular plates of substantially the same dimensions;

spacer means secured to first longitudinal edges of each of said plates to hold them substantially parallel to each other at a spacing h;

filler means for filling the volume defined by said plates, the spacer means, and a plane orthogonal to said plates located at a distance d from the second longitudinal edges of the plates; and temporary fixing means for fixing said plates to said soleplate.

7 Claims, 5 Drawing Sheets

DEVICE FOR FACILITATING THE REMOVAL OF FORMWORK

The present invention relates to a device for facilitating the removal of formwork for the end joint of a diaphragm wall panel.

BACKGROUND OF THE INVENTION

When it is desired to make a diaphragm wall, i.e. a wall made of concrete in a trench dug in the ground, this operation is performed in successive segments, each corresponding to a panel of the diaphragm wall, and the set of panels constitutes the wall.

To provide mechanical continuity between wall panels in a zone where two panels meet, the end of each panel is given a special "joint" shape enabling the end of each panel to be received in the end of the preceding panel. This shape corresponding to the joints is defined at the end of the trench that is being dug by inserting formwork of a shape that forms the joint of the panel that is being made.

With reference initially to FIGS. 1A and 1B, there follows a description of the prior art technique for making the various panels of a diaphragm wall. Initially, a first portion of trench 10 is dug corresponding to a first panel, and end joint formwork 12 is placed at the end 10*a* of the portion of trench. In conventional manner, the formwork 12 comprises a soleplate 14 and a box 16 defining the shape of the joint, and preferably also comprises a structure 18 enabling a connection element 20 to be held and protected between sealing elements that can be provided in the diaphragm wall.

As shown in FIG. 1A, the concrete constituting the panel 22 passes round the ends of the soleplate 14 of the formwork 12 in side zones referenced 24. Some of this concrete can even end up against the outside face 14*a* of the soleplate 14, as shown at 26.

In the following step, as shown in FIG. 1B, a second portion of trench 28 is dug to constitute the following panel of the diaphragm wall. During this digging, the bucket of the mechanical digger can be used to scrape the outside wall 14*a* of the soleplate 14 so as to remove the corresponding portion of concrete. However, experience shows that there always remains some of the concrete that has passed round, as referenced 24.

Prior to filling the second portion of trench 28, it is of course necessary to extract the formwork 12. This operation is difficult because of the adhesion between the concrete and both with the box 18 and with the inside face 14*b* of the soleplate 14. In addition, this operation is made even more difficult because of the presence of concrete that has passed round in the zones 24.

To solve that problem, proposals have already been made in French patent 2 613 395 to coat the face of the formwork that faces into the concrete in a thin material that can be abandoned in the trench so as to avoid adhesion between the concrete and the formwork, and to extract the formwork substantially vertically.

Proposals have also been made to solve the same problem in French patent 2 647 828 by applying a shock to the joint on its side remote from the concrete by means of a tool that is guided by the joint itself.

Another known technique for removing the formwork 12 consists in using removal "hooks" which consist, as explained in greater detail below, essentially in two hook-shaped pieces which are engaged on the edges of the soleplate of the formwork and whose active portions are engaged against the inside face of the soleplate at its edges. FIG. 1C shows the general shape of such removal hooks 30 and 32 when in place.

FIG. 1D shows a removal hook 30. It comprises one end 31 for connection to a machine, an arm 33 for passing round the side edge of the soleplate 14, and a flange 30*a* for insertion between the inside face 14*b* of the soleplate and the concrete in order to unstick the formwork from the concrete.

Because of the presence of concrete in the zones 24 where it passes round the edges of the soleplate, it is very difficult to engage the removal hooks 30 and 32. The hooks need to clear themselves a passage round the edge zones 24 over a width of 2 cm to 3 cm (referenced e) corresponding to the width of the removal hooks, and to do so over a length that may exceed 5 cm (referenced e') corresponding to how far the concrete has gone past in the zones 24. This operation puts very large stresses on the removal hooks and can lead to them breaking or at least to wearing out very prematurely. In addition, jamming phenomena make this operation difficult and thus lengthy, thereby giving rise to non-negligible cost in the construction of the diaphragm wall.

SUMMARY OF THE INVENTION

An object of the present invention is to provide a device for facilitating the removal of formwork for the end joint of a diaphragm wall panel, which device makes it possible to use removal hooks under conditions that are greatly improved thus making it possible to limit the wear on the removal hooks and to increase the speed with which the removal operation can be performed.

To achieve this object, the invention provides a device for facilitating removal of formwork for the end joint of a panel of a diaphragm wall, said formwork comprising a soleplate having an outside face, an inside face carrying a box, and two side edges, said box leaving two empty side zones on the inside face of the soleplate in the vicinity of said edges, the device comprising:

- two substantially rectangular plates of substantially the same dimensions;
- spacer means secured to a first longitudinal edge of each of said plates to hold them substantially parallel to each other at a spacing h that is substantially equal to the thickness of the soleplate of the formwork;
- filler means for filling the volume defined by said plates, by the spacer means, and by a plane orthogonal to said plates at a distance d from the other longitudinal edges of the plates, whereby the space between said plates that does not include filler means is suitable for receiving a side portion of the soleplate, said filler means being made of a low strength material; and
- temporary fixing means for fixing said plates on said soleplate.

It will be understood that by means of this disposition, the removal hooks can be engaged vertically on either side of the soleplate in register with those portions of the devices for facilitating removal that are constituted at least in part by the filler means whose mechanical strength is relatively low. Thus, the removal hooks can be pushed into the zones that have no concrete going round the edges as constituted at least in part by the relatively weak filler material.

In addition, the very presence of devices for facilitating removal limits the size of the zones occupied by the concrete that has gone round the edges.

In a first embodiment said plates and said spacer means are constituted by a metal sheet shaped to comprise two flanges interconnected by a web, and said filler means are constituted by a piece in the form of a rectangular parallelepiped disposed between the flanges of the metal sheet and against the web, said filler means being made of a plastics material that is unsuitable for being impregnated by concrete.

In a second embodiment said plates are made of wood, said spacer means are constituted by a wooden batten fixed between said plates along the first longitudinal edges thereof, and the filler means are constituted by a piece in the form of a rectangular parallelepiped disposed between said plates and against said batten, said piece being made of a plastics material that is unsuitable for being impregnated by concrete.

In a third embodiment said plates are made of wood, said spacer means are constituted by strips of wooden batten fixed between said plates along the first longitudinal edges thereof, said strips of batten leaving empty gaps between one another in the longitudinal direction of the edges of said plates, and the filler means are constituted by pieces substantially in the form of rectangular parallelepipeds of a plastics material that is unsuitable for being impregnated by concrete, said pieces being disposed in the gaps between the strips of batten.

In a preferred embodiment, the filler means are constituted by polystyrene. This material has the advantage of mechanical strength that is low compared to the removal hooks while preventing concrete filling the zone between the two plates forming the device for facilitating removal.

BRIEF DESCRIPTION OF THE DRAWINGS

Other characteristics and advantages of the invention will appear better on reading the following description of various embodiments of the invention given by way of non-limiting example. The description refers to the accompanying figures, in which.

DESCRIPTION OF THE PREFERRED

Figure 1A:
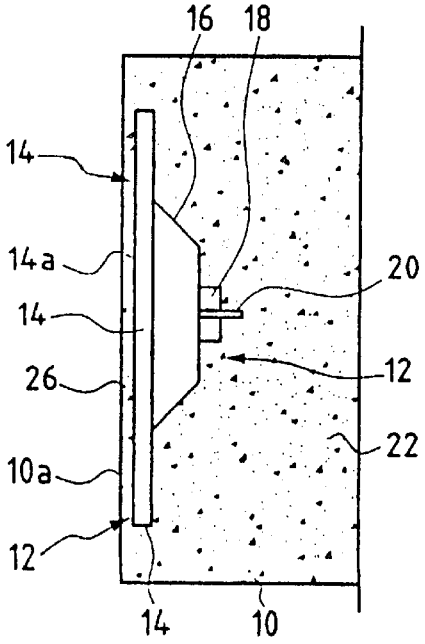
FIG.1A PRIOR ART
FIGS. 1A to 1C, described above, illustrate a prior art method of making a diaphragm wall panel.
Figure 1B:
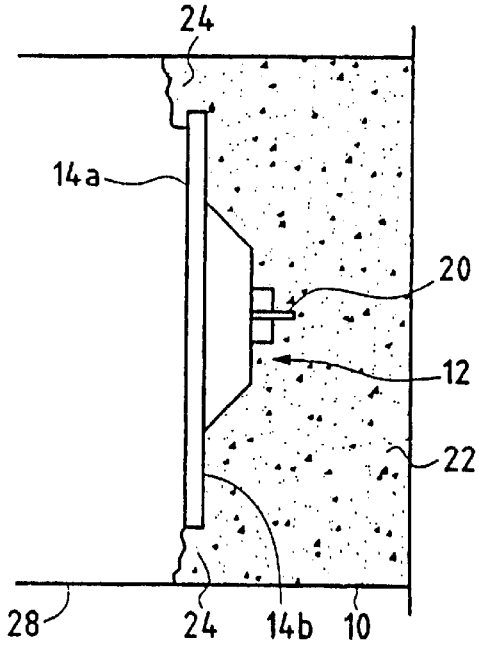
FIG.1B PRIOR ART
Figure 1C:
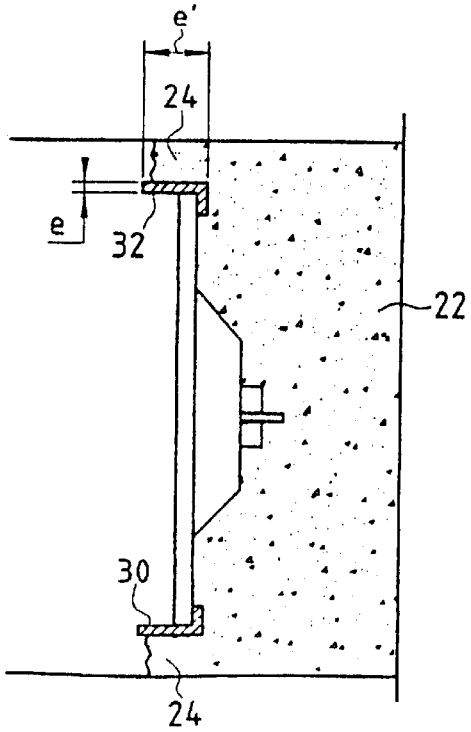
FIG.1C PRIOR ART
Figure 2:
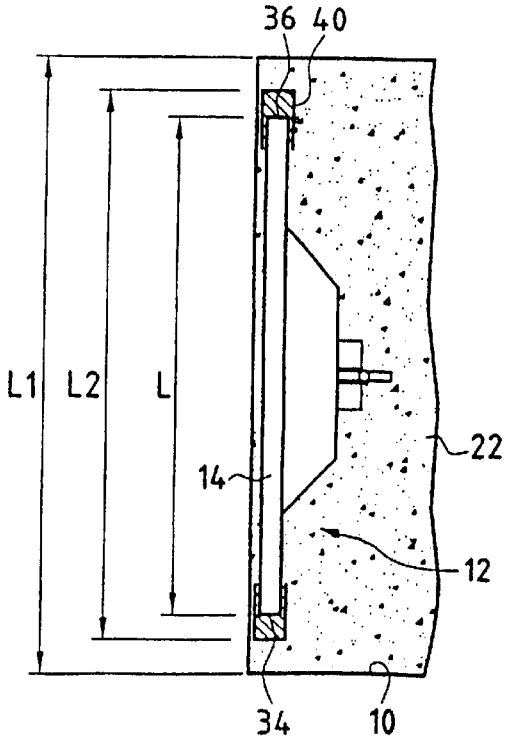
FIG. 2 is a horizontal section view showing the principle on which the devices for facilitating removal are based.
Figure 1D:
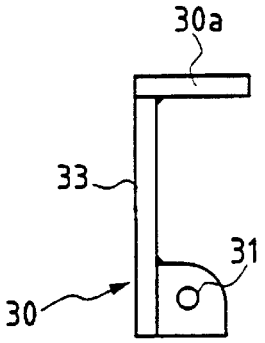
FIG. 1D, described above, shows a conventional type of removal hook.

With reference initially to FIG. 2, there follows a description of the principle on which the device for facilitating removal is based. In this figure, there can be seen formwork 12 having its soleplate 14 put into place in the trench 10 in which the wall panel 22 has already been made. The invention consists in fixing on each edge 34, 36 of the soleplate 14 a respective structure given general reference 40 and referred to below as a device for facilitating removal. This structure 40 thus projects from either side of the soleplate 14 into the trench 16 and is constituted by a set of materials of mechanical strength that is smaller than that of the removal hooks and which, by its very presence, limits the extent to which concrete can move past in the corresponding zone. This structure is described below in greater detail with reference to FIGS. 4 to 6.

Figure 3A:
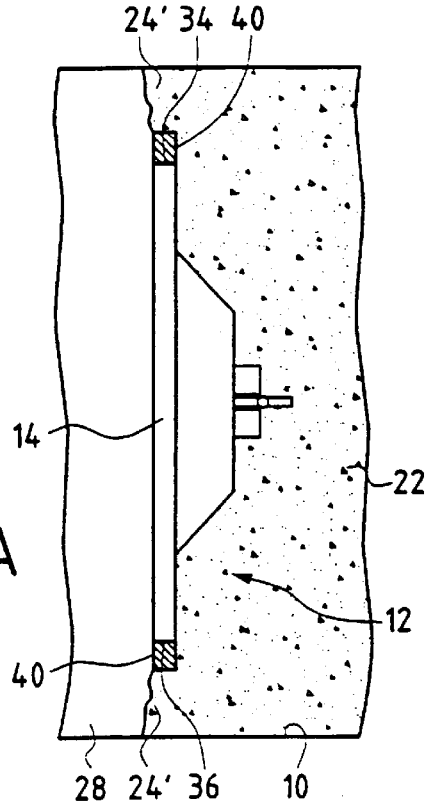
FIGS. 3A to 3C show how the removal hooks act on formwork fitted with devices for facilitating removal.
Figure 3B:
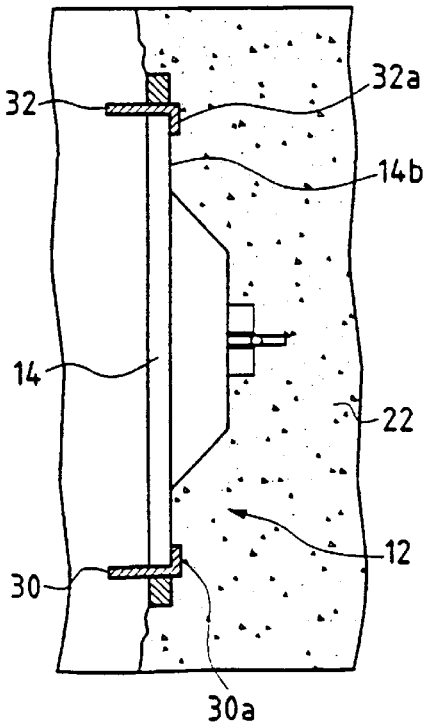
Figure 3C:
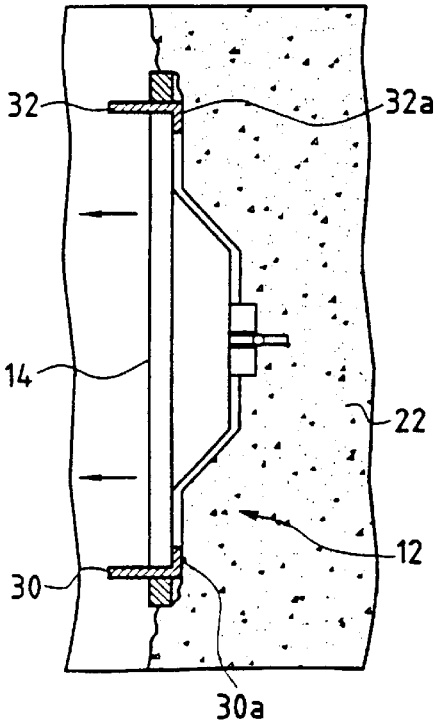

With reference now to FIGS. 3A to 3C there follows a brief description of how the devices 40 for facilitating removal are used. Before putting the formwork 12 in the trench, a device 40 for facilitating removal is fixed to each of the edges 34 and 36 of the soleplate 14 and then the formwork fitted in this way is put into place in the trench. After the first trench portion 10 has been filled with concrete and the second trench portion 28 has been dug with concrete being scraped off the outside face of the soleplate, there still remain two zones 24' of concrete that has passed round the soleplate, which zones are smaller in size than the corresponding zones in the prior art because of the presence of the devices 40. In addition, it will be understood that the devices 40 constitute two zones that are weaker than the concrete and that exist between the soleplate 14 and the zone 24' containing concrete that has gone past the soleplate. It is then possible to present the removal hooks 30 and 32 at the top end of the formwork in such a manner that the arms 33 thereof are in register with the devices 40 and the active portions 30*a* and 32*a* thereof are placed to face the inside face 14*b* of the soleplate. The machine on which the removal hooks 30 and 32 are mounted can be used to push them down, breaking their way through the devices 40 with the active portions 30*a* and 32*a* of the removal hooks causing the soleplate 14 and its box 16 to come progressively away from the concrete 22 filling the trench portion. Once the removal hooks reach the bottom portion of the formwork it can easily be extracted.

In FIG. 2, it can be seen that if the width of the soleplate 16 is referenced L, and the width of the trench 10 is referenced L1, then the dimensions of the devices 40 for facilitating removal must be such that once fixed on the soleplate, the overall width of the soleplate together with the devices, referenced L2, is less than the width L1 of the trench.

Figure 4A:
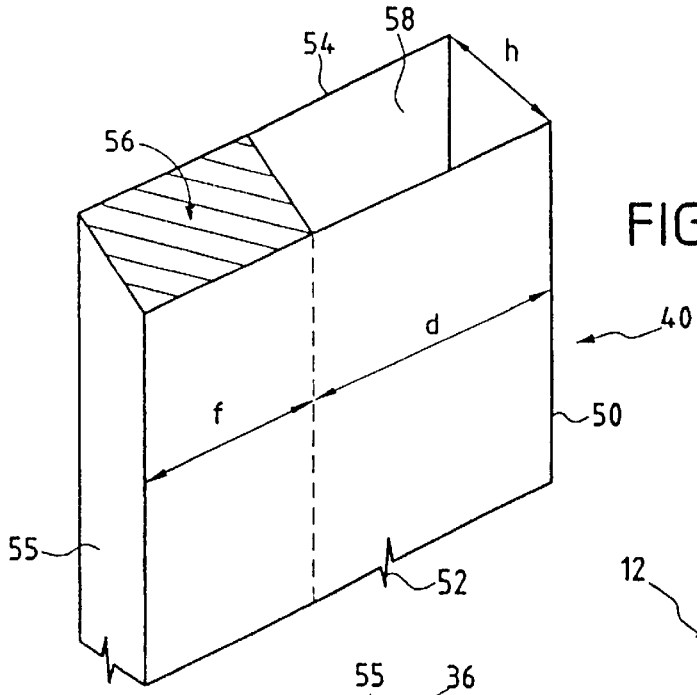
FIG. 4A shows a first embodiment of the device for facilitating removal.
Figure 4B:
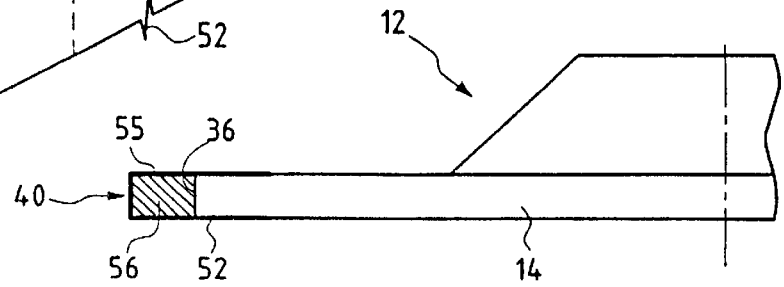
FIG. 4B shows how the FIG. 4A device for facilitating removal is put into place on formwork.

With reference now to FIGS. 4A and 4B, there follows a description of a first embodiment of the device for facilitating removal. The device 40 is constituted by stamped sheet metal 50 having two substantially parallel and rectangular flanges 52 and 54 interconnected by a web 55. The length of the sheet metal is substantially equal to the height of the soleplate. The web 55 spaces the flanges 52 and 54 apart by a distance h which is very slightly greater than the thickness of the soleplate. In the volume defined between the two flanges 52 and 54 there is fixed a piece 56 that is substantially in the form of a rectangular parallelepiped that is pressed against the web 55. This piece 56 is made of a plastics material that is unsuitable for becoming impregnated with concrete, e.g. polystyrene. Between the flanges 52 and 54, there remains an empty volume 58 of length d within which the side edge portion of the soleplate is received when the device 40 is fixed thereon. The shaped metal sheet 50 is preferably about $4/10^{ths}$ to $6/10^{ths}$ of a millimeter thick. As shown more clearly in FIG. 4B, it will be understood that the zone occupied by the piece 56 constitutes a zone of weakness into which it is easy to cause the removal hook to penetrate. Naturally, the width f of the piece 56 must be greater than the width e of the arms 33 of the removal hooks.

Figure 5A:
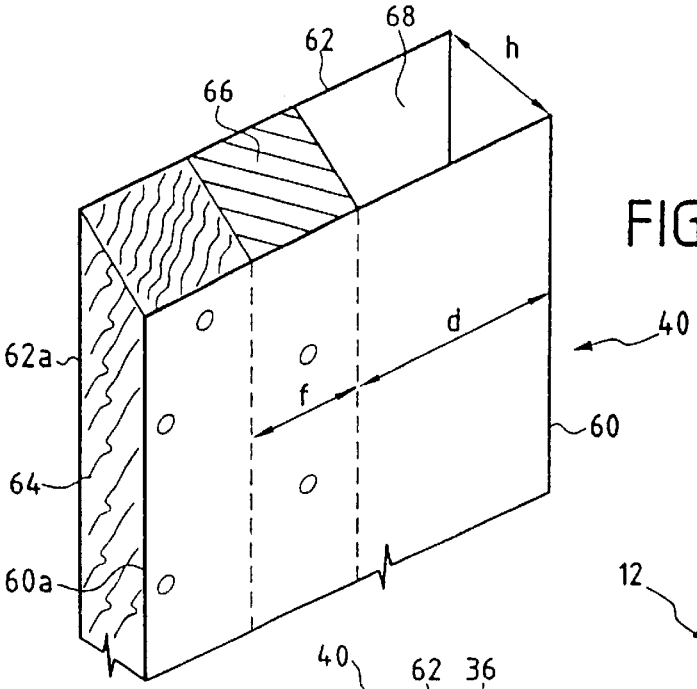
FIG. 5A is a perspective view of a second embodiment of the device for facilitating removal.
Figure 5B:
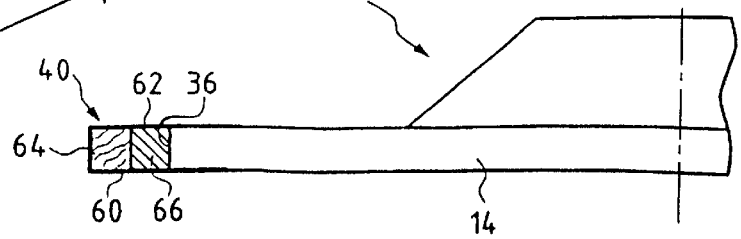
FIG. 5B shows how the FIG. 5A device for facilitating removal is put into place on formwork.

With reference now to FIGS. 5A and 5B, there follows a description of a second embodiment of the device 40 for facilitating removal. This device is constituted by two planks of wood 60 and 62 of substantially rectangular shape whose first two edges 60*a* and 62*a* are interconnected by a wooden batten 64 acting as a spacer to hold the two planks 60 and 62 substantially parallel and spaced apart by a distance h corresponding to the thickness of the soleplate. A piece 66 substantially in the form of a rectangular parallelepiped is disposed between the two planks 60 and 62 and against the batten 64. This piece 66 of width f is made of a plastics material that is unsuitable for being impregnated by concrete, e.g. polystyrene. An empty space 68 of length d thus remains between the planks 62 and 60 and suitable for receiving the side edge of the soleplate 14. As can be seen clearly more clearly in FIG. 5B, the volume constituted by the pieces 66 that are preferably made of polystyrene constitutes zones of weakness on either side of the soleplate 14 into which the removal hooks can easily be made to penetrate.

Figure 6A:
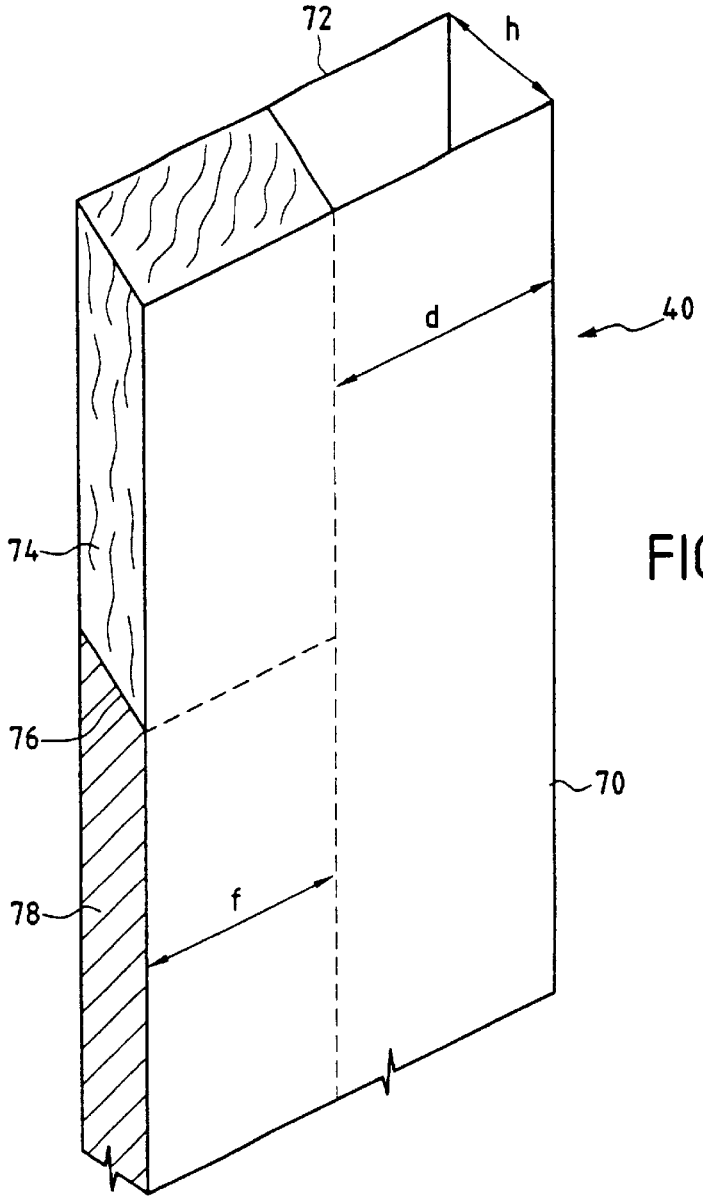
FIG. 6A is a perspective view of a third embodiment of the device for facilitating removal.
Figure 6B:
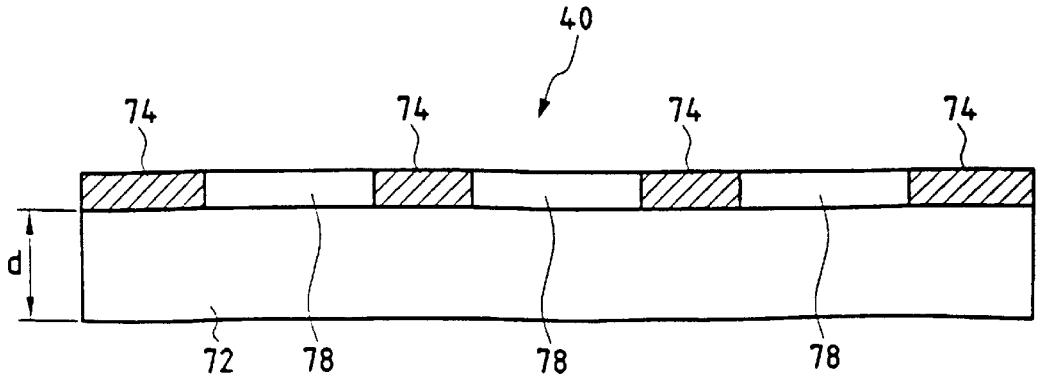
FIG. 6B shows the FIG. 6A device for facilitating removal in its vertical direction.

FIGS. 6A and 6B show a third embodiment of the device 40 for facilitating removal. In this embodiment, the device 40 is again constituted by two planks of wood 70 and 72 that are substantially rectangular and that are interconnected by lengths of wooden batten such as 74 which thus form spacers for holding the planks 70 and 72 apart at a spacing h. Gaps such as 76 are left between the strips of batten 74 fixed close to a first edge of the planks 70 and 72, and these gaps are fitted with pieces 78 made of a weak material such as polystyrene. As shown better in FIG. 6B, this provides alternating strips of batten 74 and pieces 78 of polystyrene, for example, extending parallel to the first edge of the planks 70 and 72. This assembly overall constitutes a zone of weakness of width f into which the removal hooks can penetrate easily. The zone 79 which remains empty between the planks 70 and 72 over a distance d serves to receive a side portion of the soleplate 4.

Figure 7:
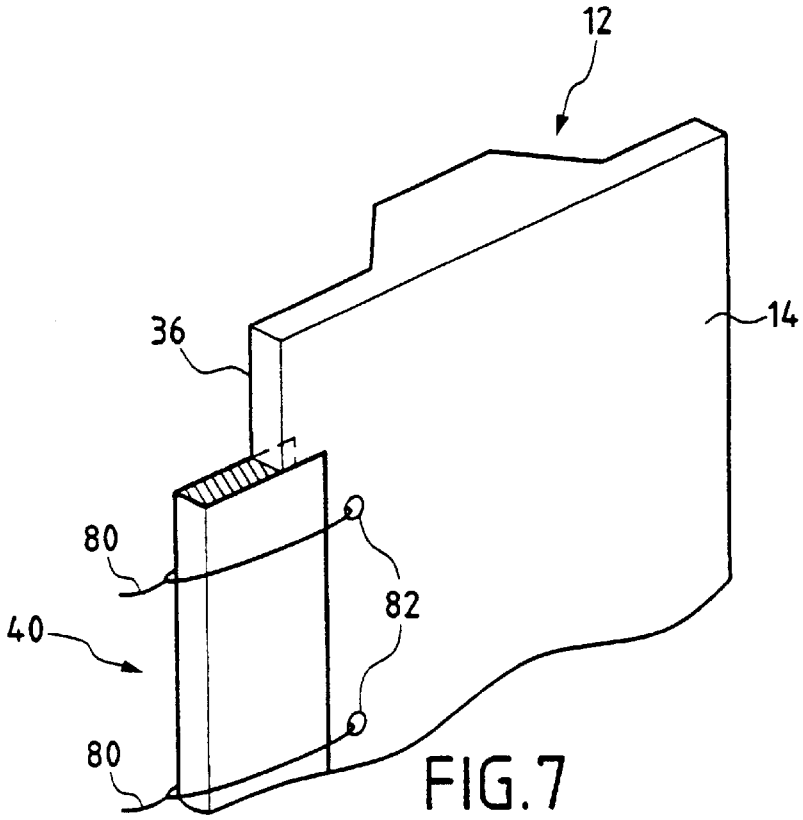
FIGS. 7 and 8 are perspective views of two preferred means for fixing a device for facilitating removal to the soleplate of formwork.
Figure 8:
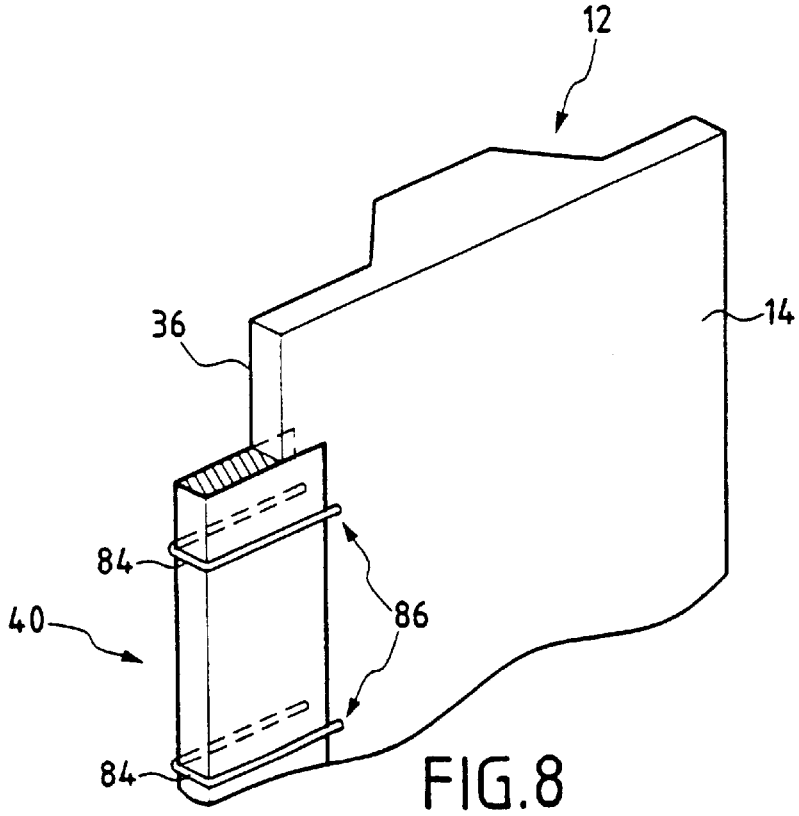

FIGS. 7 and 8 show two possible ways in which devices 40 for facilitating removal can be fixed to the soleplate 14.

In FIG. 7, the device is fixed by ties in the form of annealed wires 80 passing through holes 82 made through the soleplate 14 close to its edge 36.

In FIG. 8, the device 40 is fixed to the edge 36 of the soleplate 14 by means of metal staples 84 placed astride the device 40 and having their ends 86 welded to the inside and outside faces of the soleplate 14.

What is claimed is:

1. In combination, a formwork for making an end joint of a panel of a diaphragm wall, and two devices for facilitating removal of said formwork, said formwork comprising a soleplate having an outside face, an inside face carrying a box, and two side edges, said box being disposed such that an empty side zone is formed on the inside face of the soleplate adjacent each of said two edges, said soleplate having a defined thickness extending between said outside face and said inside face, each of the devices comprising:

two substantially rectangular plates of substantially the same dimensions, and having first and second longitudinal edges, spacer means secured to said first longitudinal edge of each of said plates to hold said plates substantially parallel to each other at a distance h that is substantially equal to the thickness of the soleplate, whereby said plates, said spacer and a plane substantially perpendicular to said plates define a first internal volume, and said plates and said plane define a second open volume, filler means disposed within said first volume and made of a material of relatively low strength, said second volume that does not include said filler means being constructed and arranged to receive a side portion of the soleplate, and means for temporarily fixing said plates on a side portion of said soleplate.

2. The combination according to claim 1, wherein said plates and said spacer means comprise a metal sheet shaped to comprise two flanges interconnected by a web, and wherein said filler means comprises a piece in the form of a rectangular parallelepiped disposed between the flanges of the metal sheet and against the web, said filler means being made of a plastics material that is unsuitable for being impregnated by concrete.

3. The combination according to claim 1, wherein said plates are made of wood, wherein said spacer means comprises a wooden batten fixed between said plates along said first longitudinal edges thereof, and wherein said filler means comprises a piece in the form of a rectangular parallelepiped disposed between said plates and against said batten, said piece being made of a plastics material that is unsuitable for being impregnated by concrete.

4. The combination according to claim 1, wherein said plates are made of wood, wherein said spacer means are constituted by strips of wooden batten fixed between said plates along said first longitudinal edges thereof, said strips of batten leaving empty gaps between one another in the longitudinal direction of the edges of said plates, and wherein said filler means are constituted by pieces substantially in the form of rectangular parallelepipeds of a plastics material that is unsuitable for being impregnated by concrete, said pieces being disposed in the gaps between the strips of batten.

5. The combination according to claim 1, wherein said filler means comprises polystyrene.

6. The combination according to claim 1, wherein said temporary fixing means comprises wires surrounding said plates and passing through holes formed through the soleplate.

7. The combination according to claim 1, wherein said temporary fixing means comprises metal staples placed astride said plates and having free ends welded to the inside and outside faces of the soleplate.

* * * * *